US005464344A

United States Patent [19]

Hufton

[11] Patent Number: 5,464,344

[45] Date of Patent: Nov. 7, 1995

[54] LOW $NO_X$ AIR AND FUEL/AIR NOZZLE ASSEMBLY

[75] Inventor: Peter F. Hufton, Derbyshire, England

[73] Assignee: Rolls-Royce Power Engineering plc, Newcastle upon Tyne, England

[21] Appl. No.: 267,369

[22] Filed: Jun. 29, 1994

[30] Foreign Application Priority Data

Jul. 8, 1993 [GB] United Kingdom ..... 9314112

[51] Int. Cl.[6] ..... F23M 3/04

[52] U.S. Cl. ..... 431/10; 431/8; 431/175; 431/187

[58] Field of Search ..... 431/10, 8, 175, 431/165, 185, 187, 183, 181, 188, 351, 189; 110/263, 347, 261, 264

[56] References Cited

U.S. PATENT DOCUMENTS

| | | | |
|---|---|---|---|
| 4,304,196 | 12/1981 | Chadshay et al. | 110/347 |
| 4,357,134 | 11/1982 | Katsushige et al. . | |
| 4,443,182 | 4/1984 | Wojcieson et al. | 431/181 |
| 4,545,307 | 10/1985 | Morita et al. | 110/347 |
| 4,842,509 | 6/1989 | Hasenack . | |
| 4,946,382 | 8/1990 | Kobayashi et al. | 431/187 |
| 5,076,779 | 12/1991 | Kobayashi | 431/175 |

FOREIGN PATENT DOCUMENTS

| | | |
|---|---|---|
| 0930589 | 7/1963 | United Kingdom . |

*Primary Examiner*—James C. Yeung
*Attorney, Agent, or Firm*—Cushman Darby & Cushman

[57] ABSTRACT

An apparatus and method are provided for reducing $NO_x$ production during combustion in an tangential burner. Air nozzles are arranged tangentially to a fuel/air nozzle and are tilted relative to the fuel air nozzle. Upon operation, spaces are formed between the air flow and the fuel flow which entrain laterally combustion gases thereby delaying mixing of the air and fuel flows. By this delay, $NO_x$ production is reduced.

9 Claims, 3 Drawing Sheets

LOW $NO_X$ AIR AND FUEL/AIR NOZZLE ASSEMBLY

The present invention relates to a fuel/air nozzle assembly of the kind utilized in the combustion chamber of an industrial boiler. Such nozzle assemblies comprise one or more flow nozzles which emit a mixture of fuel (coal, gas or oil) and air, and additional nozzles which straddle each mixed flow nozzle and emit only air.

In some known arrangements all of the nozzles are fixed. In other known arrangements, all of the nozzles are pivotable in a common plane. In both arrangements however, the axes of the nozzles are maintained parallel with each other.

Some of the nozzles described hereinbefore often include features such flame attachment features, whereupon on ignition of the fuel/air mix, the resulting flame attaches to the nozzle outlet plane and extends therefrom into the combustion chamber. Ensuring a reduction in the production of nitrous oxide.

It is also known to provide a splitter within a mixed flow nozzle so that the mixed flow diverges on exit. This splitter, however, merely creates a low pressure, substantially stable zone between the diverging flow paths, and is aimed only at improving ignition characteristics.

The present invention seeks to provide an air and fuel/air nozzle assembly, that further reduces NOx production.

According to the present invention an air and fuel/air nozzle assembly comprises a first nozzle, defining a fuel flowpath, through which a mixed flow of fuel and air passes to a combustion chamber, and first and second air nozzles having first and second air nozzles axes which straddle said flow nozzle and are adapted so that they respectively eject air into said combustion chamber in directions which diverge from the flow nozzle axis of the flow nozzle by up to at least 10° in a plane containing the axes of all the nozzles so as to create regions on either side of the fuel/air flowpath into which combustion gases are entrained laterally from the combustion chamber.

In one embodiment of the present invention each air nozzle is positioned at an attitude so that its air nozzle axis defines a divergent angle of up to at least 10° with the axis of the flow nozzle.

In a second embodiment of the present invention each air nozzle is provided with deflectors or other deflecting members arranged to deflect air from the air nozzle towards the axis of the air nozzle at an included angle of up to at least 20°.

In both embodiments the assembly may be pivotable so as to enable simultaneous tilting of the nozzles relative to respective air and fuel/air passageway structure to which the nozzles are connected. Preferably the nozzles of the nozzle assembly are interconnected by a linkage to achieve simultaneous tilting.

The invention will now be described, by way of example and with reference to the accompanying drawings in which.

Figure 1:
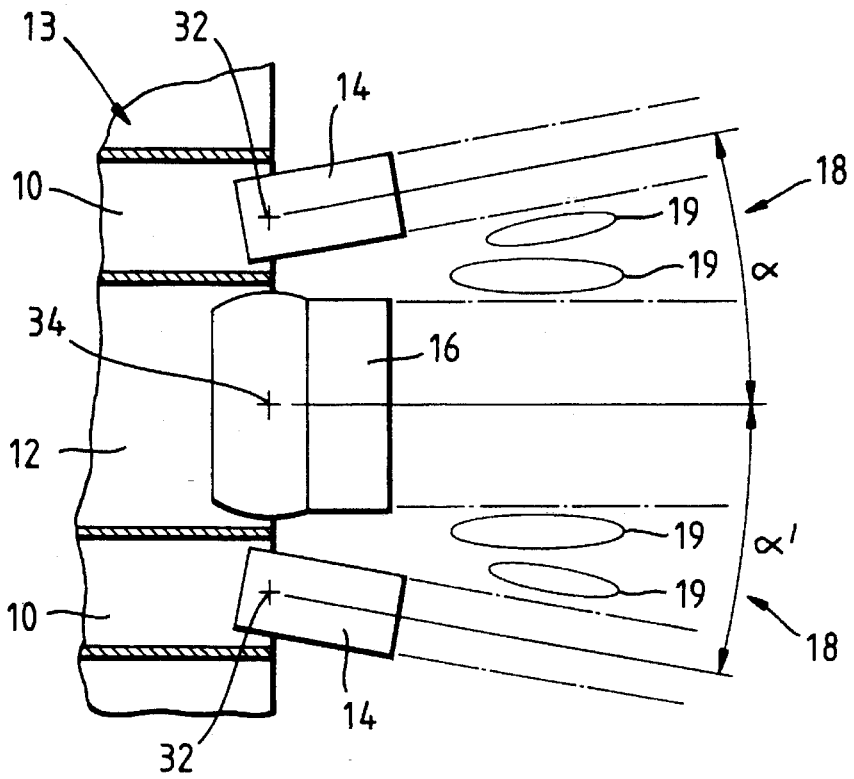
FIG. 1 is a diagrammatic cross sectional side view of a nozzle assembly in accordance with the present invention.

Referring to FIG. 1. A vertically arranged column of passageways 10 and 12 are defined by a box structure 13 in a known manner. Passageways 10 carry respective flows of air to nozzles 14 and a passageway 12 carries a mixture of fuel, coal for example, and air to nozzle 16.

Passageways 10 and their associated air nozzles 14 straddle the passageway 12 and its associated flow nozzle 16, and are tilted relative thereto so that in operation, their flows are caused to diverge from the direction of flow of the coal/air mixture from nozzle 16, in a plane which contains the flow nozzle and first and second air nozzle axes. By this action, spaces 18 are formed on externally each side of the coal/air flow emitted by the nozzles. Those spaces become filled with combustion gases and are entrained laterally from the furnace.

Air and coal/air flows from the nozzles 14 and 16 entrain the combustion gases at the interface therebetween and transport them back to the chamber interior, whereupon adjacent combustion gases in the combustion chamber flow into the spaces 18, thus setting up a flow within the spaces 18. This flow has the effect of delaying mixing of the airflows from nozzles 14 with the coal/air flow from nozzle 16 and reducing the oxygen content of the mixture arising. The mixing occurs downstream of the outlet plane of the nozzle 16.

In addition there is an increase in local turbulence levels and temperature of the gas mixture. The effect of these changes is seen in the graphs shown as FIGS. 3 and 4.

Figure 3:
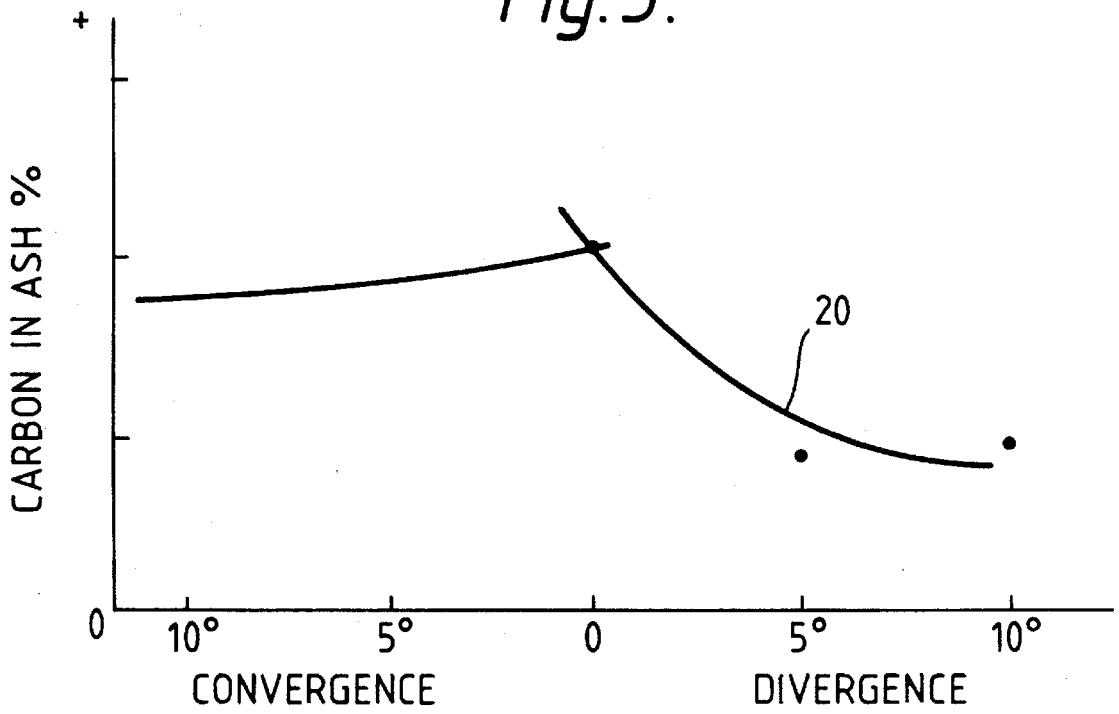
FIG. 3 is a graphical representation of the reduction of carbon in a combustion chamber which incorporates the present invention.

In FIG. 3 burner testing was effected during which the air nozzles 14 were operated in attitudes ranging from a 10° angle of convergence relative to the fuel/air nozzle 16, to 10° angle of divergence. Starting at 10° convergence the percentage of carbon in ash increased until the angle became zero, ie parallel with the nozzle 16. Between 0° and 10° divergence there is a marked drop in the level of carbon in ash due to the improved mixing and increase in mixture temperature.

Figure 4:
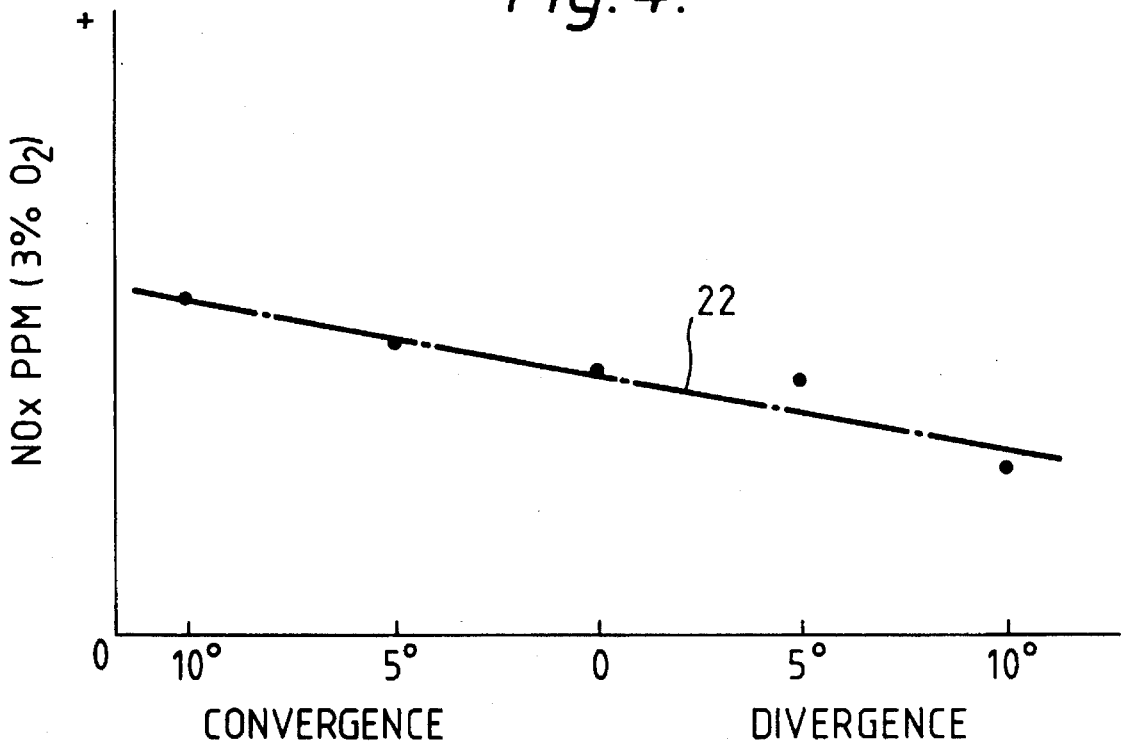
FIG. 4 is a graphical representation of the reduction in NOx in a combustion chamber which incorporates the present invention.
Figure 5:
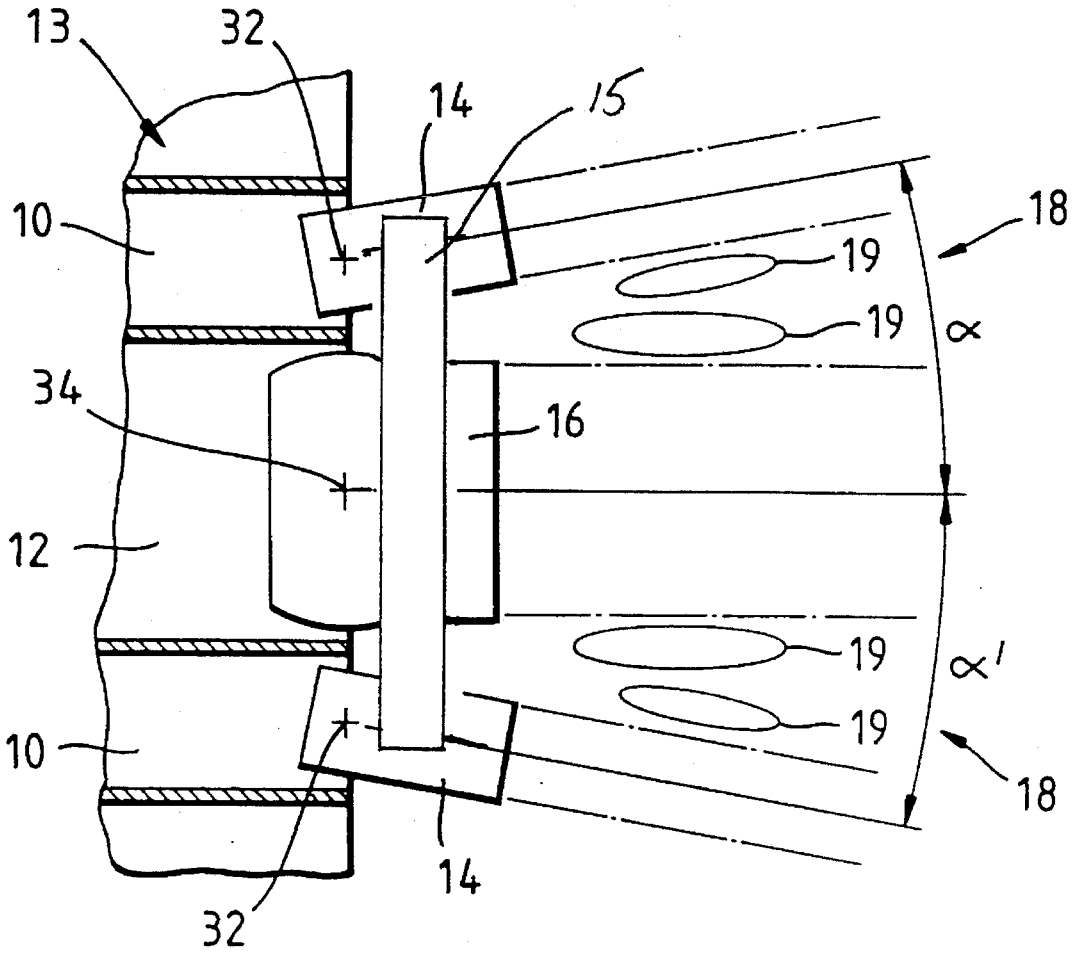
FIG. 5 is a diagrammatic view of the linkage of the tilting mechanism of the present invention.

FIG. 4 shows how the NOx levels changed for the same variations in air nozzle angle. Over the entire angle change from 10° convergence to 10° divergence the NOx level drops steadily indicating that the reduction in oxygen is the dominant effect with respect to this parameter. Thus a divergent airflow is able to create conditions leading to lower levels of NOx and reduced levels of carbon in ash simultaneously.

The continuing downward trend of the line 22 implies that further NOx reductions are possible if the divergance is taken beyond 10°.

Figure 2:
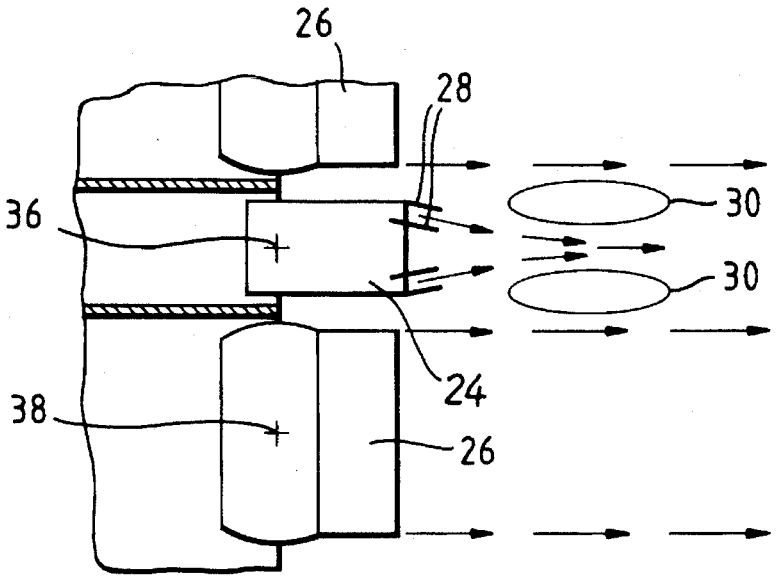
FIG. 2 is a diagrammatic cross sectional side view of an alternative nozzle assembly in accordance with the present invention.

Referring now to FIG. 2. The air nozzle 24 depicted therein is not intended to be angularly displaced relative to associated fuel/air nozzles 26. Instead it is aligned in parallel therewith, and its outlet end is provided with deflectors 28, which deflect the airflow therefrom towards its axis at an included angle of up to at least 20°. By this means combustion gases 30 are caused to circulate between the air and fuel/air flows.

Provided the proportions of the nozzle 24 are sufficient to ensure delivery of the required amount of air, the arrangement depicted in FIG. 2 permits the use of one nozzle 24 between fuel/air nozzles 26, rather than two, as would be required in FIG. 1.

In systems known in the art as tangential firing systems, all of the nozzles are tilted in a common direction. The tilting action is achieved by linkages which may or may not be attached to a unison bar, which in turn, is actuated, for example, by ram mechanisms.

The nozzles 14, 16, 24 and 26 are also tiltable, about pivot axes 32, 34 and 36, 38 respectively. They are first positioned in the required relative divergent attitudes and then rotated in unison by linkages of the kind described hereinbefore. The fixing would be achieved by using linkages of appropriate relative proportions and connected to the nozzles at appropriate points, all of which is within the capabilities of the ordinary person skilled in the art.

I claim:

1. An air and fuel nozzle assembly for emitting air and fuel into a combustion chamber and reducing $NO_x$ production comprising:

a box structure having a fuel passageway and an air passageway spaced laterally from the fuel passageway;

a flow nozzle having a flow nozzle axis in a plane and having a bore therethrough defining a fuel flowpath parallel to the flow nozzle axis positioned to emit a mixture of air and fuel into the combustion chamber, the mixed flow nozzle being in operative relation with the fuel passageway;

an air nozzle having an air nozzle axis in the plane and having a bore therethrough defining an air flowpath parallel to the air nozzle axis positioned to emit air into the combustion chamber, the air nozzle being laterally spaced in the plane from the flow nozzle such that the air nozzle axis is parallel to the flow nozzle axis, the air nozzle being in operative relation with the air passageway; and a deflecting member connected to an outlet end of the air nozzle positioned to deflect inwardly the emitted air at an included angle towards the air nozzle axis thereby creating, upon operation of the assembly, spaces between the emitted air and the emitted mixture of air and fuel into which combustion gases flow and are entrained laterally delaying mixture of the air and the mixture of air and fuel.

2. An air and fuel nozzle assembly according to claim 1, wherein said flow nozzle and said air nozzles diverge with an angle between them and said angle is at least 10°.

3. An air and fuel nozzle assembly according to claim 1, wherein the included angle is at least 20°.

4. An air and fuel nozzle assembly according to claim 1, wherein the flow nozzle is rotatable in the plane about a first pivot axis perpendicular to the mixed flow nozzle axis, the first and second air nozzles are rotatable in the plane about second and third pivot axes, respectively, perpendicular to the first and second air nozzle axes, respectively, further comprising tilting means for pivoting simultaneously the nozzles and maintaining said included angle as a divergent angle.

5. An air and fuel nozzle assembly according to claim 1, wherein said flow nozzle emits a mixture of air and fuel into the combustion chamber at a first divergent angle and said air nozzle emits air into said combustion chamber at a second divergent angle and the first divergent angle is equal to the second divergent angle.

6. A method for reducing $NO_x$ production during combustion comprising:

conveying a fuel by air such that a mixture of air and fuel is formed and injecting the mixture of air and fuel into a combustion chamber through a flow nozzle having an axis being in a plane;

injecting an oxidant into the combustion chamber at a first divergent angle in the plane on one side of the axis;

injecting the oxidant into the combustion chamber at a second divergent angle in the plane on an opposite side of the axis such that spaces are formed between the injected mixture of air and fuel and the injected oxidant into which combustion gases flow and are entrained laterally delaying the mixing of the oxidant and the mixture of air and fuel; and combusting the mixture of oxidant and fuel.

7. A method for reducing $NO_x$ production during combustion comprising:

conveying a fuel by air such that a mixture of air and fuel is formed and injecting the mixture of air and fuel into a combustion chamber through a flow nozzle having a flow nozzle axis;

injecting an oxidant into the combustion chamber through an oxidant nozzle having an oxidant nozzle axis generally parallel to the flow nozzle axis;

deflecting inwardly at an angle the oxidant towards the oxidant nozzle axis such that spaces are formed between the injected mixture of air and fuel and the injected oxidant into which combustion gases flow and are entrained laterally delaying the mixing of the oxidant and the mixture of air and fuel; and combusting the mixture of oxidant and fuel.

8. A method for reducing $NO_x$ production during combustion according to claim 6, wherein the first and second divergent angles are at least 10°.

9. A method for reducing $NO_x$ production during combustion according to claim 7, wherein the angle is at least 20°.

* * * * *